US006889673B2

(12) United States Patent
Bender et al.

(10) Patent No.: US 6,889,673 B2
(45) Date of Patent: May 10, 2005

(54) DEVICE FOR EXHAUST-GAS RECIRCULATION

(75) Inventors: Franz Bender, Wendlingen (DE); Hermann Büter, Stuttgart (DE); Philipp Weber, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 151 days.

(21) Appl. No.: 10/386,416

(22) Filed: Mar. 12, 2003

(65) Prior Publication Data

US 2004/0079347 A1 Apr. 29, 2004

(30) Foreign Application Priority Data

Mar. 13, 2002 (DE) ..... 102 10 971

(51) Int. Cl.[7] ..... F02M 25/07
(52) U.S. Cl. ..... 123/568.17
(58) Field of Search ..... 123/568.11, 568.17, 123/568.18, 568.2; 60/605.2

(56) References Cited

U.S. PATENT DOCUMENTS

| | | | | |
|---|---|---|---|---|
| 3,626,913 A | * | 12/1971 | Sarto | 123/568.17 |
| 4,094,285 A | * | 6/1978 | Oyama et al. | 123/568.17 |
| 4,969,446 A | * | 11/1990 | Olsson et al. | 123/568.17 |
| 6,425,382 B1 | * | 7/2002 | Marthaler et al. | 123/568.17 |
| 6,427,671 B1 | * | 8/2002 | Holze et al. | 123/568.17 |
| 6,513,508 B2 | * | 2/2003 | Fischer et al. | 123/568.17 |
| 6,609,374 B2 | * | 8/2003 | Feucht et al. | 123/568.17 |
| 6,672,292 B2 | * | 1/2004 | Fischer | 123/568.17 |

* cited by examiner

*Primary Examiner*—Willis R. Wolfe, Jr.
(74) *Attorney, Agent, or Firm*—Klaus J. Bach

(57) ABSTRACT

In a device for exhaust gas recirculation, with an intake duct and an exhaust gas recirculation duct, which projects into the intake duct and via which exhaust gas is recirculated to the fresh air in the intake duct, the exhaust gas recirculation duct has an outlet orifice oriented toward the fresh gas inlet flow and a diverting device is disposed in front of the outlet orifice for redirecting the exhaust gas discharged front the outlet orifice in the direction of flow of the fresh air in the intake duct.

7 Claims, 1 Drawing Sheet

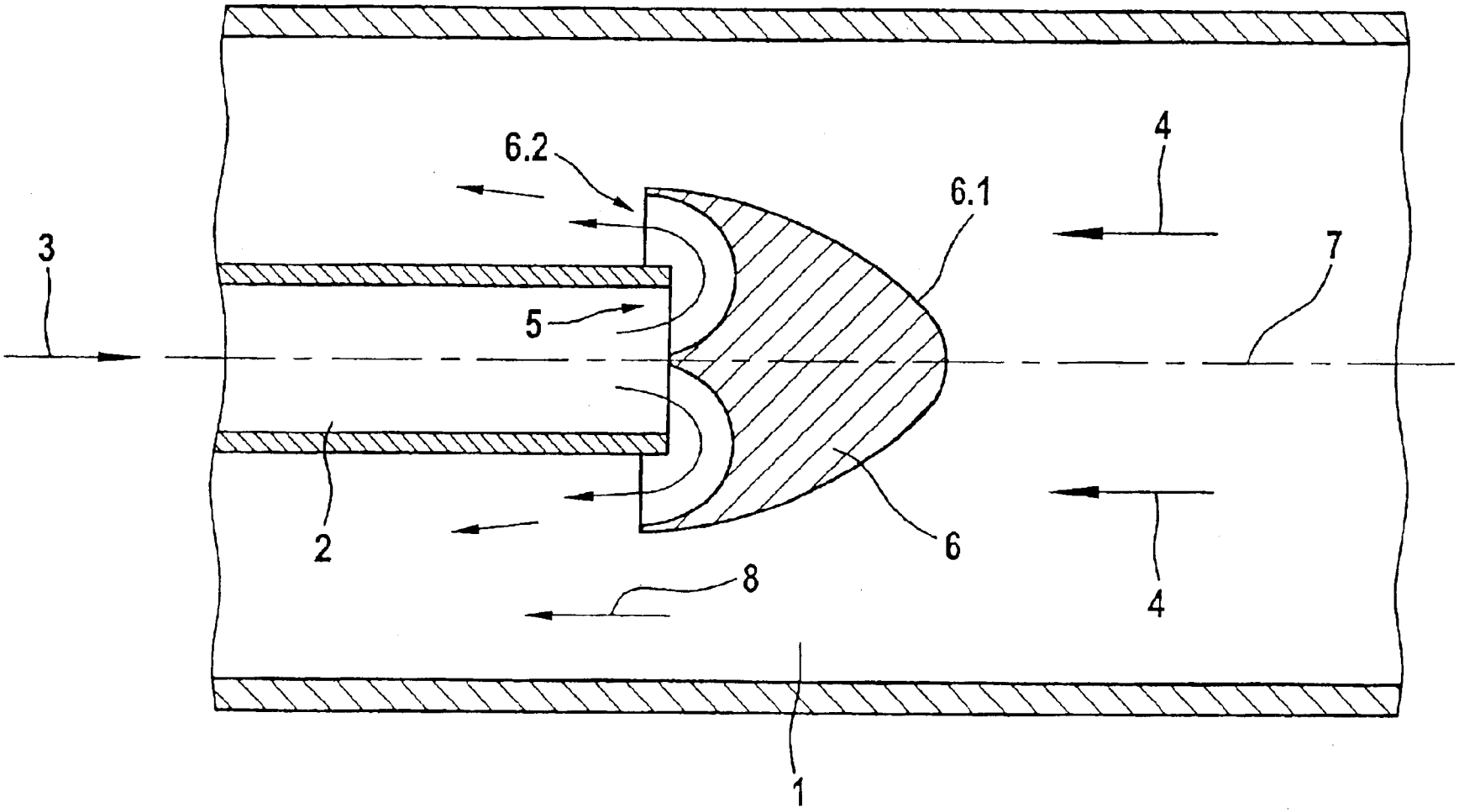
7
4
4
6.1
6
1
8
6.2
5
2
3

DEVICE FOR EXHAUST-GAS RECIRCULATION

BACKGROUND OF THE INVENTION

The invention relates to a device for exhaust-gas recirculation with at least one intake duct for supplying fresh intake air to an engine and with an exhaust-gas recirculation duct which projects into the latter and via which re-circulated exhaust gas is delivered to the fresh intake air.

A device for exhaust-gas recirculation with an exhaust gas recirculation duct and with a closing element capable of being actuated for controlling the flow of exhaust gas into the intake duct is already known. The exhaust gas recirculation duct is connected to the intake duct such that the exhaust gas recirculation duct can be opened and closed via a closing element actuable by an control drive. For this purpose, an exhaust-gas supply nozzle in the form of an essentially cylindrical exhaust-gas supply pipe having an outlet orifice in its cylindrical wall projects into the intake duct approximately perpendicularly to the fresh-gas flow. Arranged as a closing element above the outlet orifice is a bell-shaped rotary-slide cover, which, at least partially, surrounds the exhaust-gas supply pipe projecting into the intake duct. The bell-shaped rotary-slide cover is coupled to an electric pivoting motor serving as a control drive. This is a device in which only minimal forces caused by the exhaust gas and fresh gas stream act on the closing element and its adjusting drive. However, the known device is complicated and costly.

It is the object of the present invention is to provide an exhaust-gas recirculation device in such a way that uniform exhaust-gas flow rates and an equal distribution of the gas in the fresh air can be achieved.

SUMMARY OF THE INVENTION

In a device fore exhaust gas recirculation, with an intake duct and an exhaust gas recirculation duct which projects into the intake duct and via which exhaust gas is recirculated to the fresh air in the intake duct, the exhaust gas recirculation duct has an outlet orifice oriented toward the fresh gas inlet flow and a diverting device is disposed in front of the outlet orifice for redirecting the exhaust gas discharged from the outlet orifice in the direction of flow of the fresh air.

What is achieved thereby is an extension of the exhaust-gas mixing zone, so that the recirculated exhaust gas can be delivered far into the duct carrying the fresh air and is supplied to the fresh air via a correspondingly shaped diverting device which may be designed, for example, as a baffle body. The introduction point is preferably so designed that the recirculated gas can be supplied to the fresh air at an early stage, in order to ensure as long a mixing zone as possible for the fresh air and exhaust gas, so that a good homogeneous distribution of the exhaust gas in the intake-air in a good mixture is achieved. By means of the advantageous device, therefore, the recirculated exhaust gas does not flow along the outer wall of the duct carrying the fresh air, so that deposits will not block the flow of fresh air in the area in which of the exhaust-gas is introduced into the fresh air intake duct.

For this purpose, it is advantageous if the diverting device is arranged concentrically within the intake duct.

According to one embodiment, the diverting device has, upstream of the exhaust gas outlet orifice, one or more concavely designed diverting elements.

Furthermore, it is advantageous if the diverting elements are oriented co-axially to the mid-axis of the intake duct.

It is also advantageous, for this purpose, that the diverting device extends into the intake duct upstream and includes at its end a first convexly designed part acting as a flow divider and at least one second part following in the direction of flow, by means of which parts the exhaust gas flow through the exhaust gas recirculation pipe is revised and deflected in the direction of flow of the fresh intake air.

Finally, in a preferred embodiment of the invention, the convexly designed deflecting part is in the form of an annular trough.

It is particularly important for the present invention that the first part is of conical or pyramidal design.

Furthermore, it is advantageous that the position between the outlet end of the exhaust-gas recirculation duct and the diverting device is adjustable.

Further advantages and details of the invention will be described below in greater detail and illustrated on the basis of the drawing.

BRIEF DESCRIPTION OF THE DRAWINGS

The sole FIGURE illustrates a device for exhaust-gas recirculation.

DESCRIPTION OF A PREFERRED EMBODIMENT

The FIGURE shows an intake duct 1 with only a pipe section being shown in the drawing. Located concentrically in the pipe section as illustrated in the drawing is an exhaust-gas recirculation duct 2, via which exhaust gas 3 is supplied to the intake duct 1. A diverting device 6, which may also be designed as a baffle body, is located in the region of the outlet end or of the outlet orifice 5 of the exhaust-gas recirculation duct 2. The diverting device consists of a first convexly designed part 6.1, which acts as a flow divider and which has an annular convexly designed trough. Furthermore, the diverting device has a second conical body or part 6.2 pointing opposite to the direction of the exhaust gas flow. As already mentioned, the baffle body or diverting device 6 is arranged concentrically in the intake duct 1. Instead of the annular convex part 6.2, a plurality of individual diverting elements 6.2 may be provided, which are likewise oriented coaxially with the center-axis 7 of the intake duct 1.

Furthermore, it is possible to modify the position between the outlet end or the outlet orifice 5 of the exhaust-gas recirculation duct and the recirculation body 6.

The diverting device 6 is fastened via fastening elements, not illustrated in the drawing, either to the exhaust-gas recirculation duct 2 or to the side walls of the intake duct.

What is claimed is:

1. A device for exhaust gas recirculation, comprising an intake duct (1), an exhaust gas recirculation duct (2) projecting into the intake duct (1) for conducting exhaust gas (3) into the intake duct (1) in a direction opposite to the flow of fresh air (4), said exhaust gas recirculation duct having an outlet orifice (5) facing the fresh air flow through said intake duct (1) and a diverting device (6) disposed in front of said outlet orifice (5) for redirecting the flow the exhaust gas so as to be discharged centrally into the intake duct (1) in the direction of the flow (8) of the fresh air (4).

2. A device according to claim 1, wherein said diverting device (6) is arranged on the longitudinal center-axis (7) of the intake duct (1).

3. A device according to claim 2, wherein said diverting device (6) has, upstream of the outlet orifice (5), at least one concavely designed diverting element (6.2).

4. A device according to claim 2, wherein the diverting device (6) has a convexly designed front part (6.1) acting as a flow divider and at least one second part (6.2) downstream in the direction of the intake air flow, by means of which parts the exhaust gases (3) are deflected in the direction of intake air flow (8).

5. A device according to claim 4, wherein the convexly designed deflecting part (6.2) is designed as an annular trough.

6. A device according to claim 4, wherein the first part (6.1) of said diverting device (6) is of a streamlined design.

7. A device according to claim 4, wherein the spacing between the outlet orifice (5) of the exhaust gas recirculation duct (2) and the diverting device (6) is adjustable.

* * * * *